US008348053B2

(12) United States Patent
Bellamah et al.

(10) Patent No.: US 8,348,053 B2
(45) Date of Patent: Jan. 8, 2013

(54) ADJACENT ARTICLE PACKAGE FOR CONSUMER PRODUCTS

(75) Inventors: Stephen J. Bellamah, Midlothian, VA (US); William T. Griffin, Chesterfield, VA (US); Dominic J. C. Howard, New Canaan, CT (US); William E. Tucker, Jr., Charlotte, NC (US); John A. Konings, Richmond, VA (US); Xuan M. Pham, Glen Allen, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 12/848,696

(22) Filed: Aug. 2, 2010

(65) Prior Publication Data

US 2011/0162984 A1 Jul. 7, 2011

Related U.S. Application Data

(63) Continuation of application No. 12/634,331, filed on Dec. 9, 2009, now abandoned.

(60) Provisional application No. 61/122,068, filed on Dec. 12, 2008.

(51) Int. Cl.
*A24F 15/00* (2006.01)
*B65D 85/10* (2006.01)
*B65D 85/12* (2006.01)

(52) U.S. Cl. ..... 206/271; 229/104; 229/122.3

(58) Field of Classification Search ..... 206/271, 206/273, 250, 260, 270, 236; 229/122, 87.14, 229/87.13, 75, 103.2, 125.15, 104, 122.31, 229/5.5; 131/175

See application file for complete search history.

(56) References Cited

U.S. PATENT DOCUMENTS

| | | | |
|---|---|---|---|
| 1,906,742 | A | 3/1929 | Coulapides |
| 2,011,399 | A | 11/1932 | Driscoll |
| 2,163,828 | A | 6/1939 | Chalmers |
| 2,238,568 | A | 4/1941 | Rothar |
| 2,247,870 | A | 7/1941 | Chalmers |
| 2,279,842 | A | 4/1942 | Smith et al. |
| 2,494,724 | A | 1/1950 | Schmidt |
| 2,596,620 | A | 5/1952 | Townsend |
| 2,671,731 | A | 3/1954 | Vogt |
| 2,782,910 | A | 2/1957 | Leibow |
| 2,784,539 | A | 3/1957 | Silver |
| 3,007,623 | A | 11/1961 | Clemens |
| 3,039,671 | A | 6/1962 | Chiamardas |
| 3,112,029 | A | 11/1963 | Davey |
| 3,124,298 | A | 3/1964 | Repko |
| 3,226,010 | A | 12/1965 | Rogers, Jr. |
| 3,241,738 | A | 3/1966 | Freiman |

(Continued)

FOREIGN PATENT DOCUMENTS

EP 2072410 A1 6/2009

*Primary Examiner* — Bryon Gehman
*Assistant Examiner* — Rafael Ortiz
(74) *Attorney, Agent, or Firm* — Buchanan Ingersoll & Rooney PC

(57) ABSTRACT

An adjacent article package for holding a consumer product and a promotional product includes a combining sleeve formed from a blank. The first container can be a pack of cigarettes and the second container can be a small package containing promotional products such as smokeless tobacco products. The adjacent article package can be sized to be compatible with cigarette cartons, cigarette display racks, tax-stamping equipment and the like.

16 Claims, 8 Drawing Sheets

U.S. PATENT DOCUMENTS 3,399,763 A 9/1968 Stone
3,489,333 A 1/1970 Culberg et al.
3,563,449 A 2/1971 Forbes, Jr.
3,608,704 A 9/1971 Kopp
3,608,705 A * 9/1971 Moshel ..... 206/461
3,858,788 A 1/1975 Phillips, Jr.
3,901,386 A 8/1975 Hennessey
3,910,487 A 10/1975 Jaeschke
3,961,742 A 6/1976 Stark et al.
3,979,047 A 9/1976 Focke et al.
4,003,467 A 1/1977 Focke et al.
4,079,567 A 3/1978 Spruyt et al.
4,081,126 A 3/1978 Barnard
4,114,777 A 9/1978 Frohling et al.
4,121,756 A 10/1978 Focke et al.
D251,361 S 3/1979 Adreon
4,159,076 A * 6/1979 Engdahl, Jr. ..... 229/132
4,193,534 A 3/1980 Focke et al.
4,205,775 A * 6/1980 Swan ..... 229/104
4,308,952 A 1/1982 Paulucci
4,616,751 A 10/1986 Forbes, Jr.
4,666,079 A 5/1987 Bolli et al.
4,727,890 A 3/1988 Vincent
4,850,482 A 7/1989 Campbell
4,862,431 A 8/1989 Drouin
4,948,038 A 8/1990 Moeller
4,989,728 A * 2/1991 Neyret et al. ..... 206/91
5,000,375 A 3/1991 Farber et al.
5,014,500 A 5/1991 Robache
5,074,412 A 12/1991 White
5,180,056 A 1/1993 Adams et al.
5,201,413 A 4/1993 DeBlasio et al.
5,205,403 A 4/1993 DeBlasio
5,366,077 A 11/1994 Pham
5,388,594 A 2/1995 Counts et al.
5,505,214 A 4/1996 Collins et al.
5,513,752 A 5/1996 Gottlieb
5,530,225 A 6/1996 Hajaligol
5,570,779 A * 11/1996 Draucker et al. ..... 206/246
5,591,368 A 1/1997 Fleischhauer et al.
5,630,503 A 5/1997 Rhodes et al.
5,799,781 A 9/1998 Arthur
5,826,785 A 10/1998 Belvederi et al.
5,848,595 A 12/1998 Arthur
5,899,326 A 5/1999 Benhamou et al.
5,907,944 A 6/1999 Giacoman
6,003,759 A * 12/1999 Kenner et al. ..... 229/104
6,138,437 A 10/2000 Focke et al.
6,173,833 B1 1/2001 Strehlow
6,193,148 B1 * 2/2001 Shimada ..... 229/104
6,244,434 B1 6/2001 Brooks
6,311,860 B1 11/2001 Reidinger et al.
6,401,918 B1 6/2002 Focke et al.
6,435,342 B1 8/2002 Agnes
6,467,614 B1 10/2002 Tallier et al.
6,470,653 B1 10/2002 Lutz et al.
6,474,469 B1 11/2002 Luton et al.
6,540,073 B1 4/2003 Hagel et al.
6,592,023 B2 7/2003 Li Vigni et al.
6,693,850 B2 2/2004 Mulaw
6,823,989 B2 11/2004 Wilder et al.
6,837,369 B2 1/2005 Amos
6,932,219 B2 8/2005 Chacko et al.
6,971,521 B2 12/2005 Pinyot
6,993,887 B2 2/2006 Dharssi et al.
7,044,294 B2 5/2006 Lutzig
7,070,055 B2 7/2006 Lechanoine et al.
7,114,504 B2 10/2006 Fox
7,124,883 B1 10/2006 Thomas et al.
7,174,938 B2 2/2007 Cadieux, Jr. et al.
7,185,659 B2 3/2007 Sharpe
D542,466 S 5/2007 Polloni et al.
7,234,593 B2 6/2007 Fath et al.
2005/0056554 A1 3/2005 Fath et al.
2006/0011498 A1 1/2006 Giannini et al.
2006/0283721 A1 12/2006 Kutsch et al.
2007/0012711 A1 1/2007 Kutsch et al.
2007/0251984 A1 11/2007 Bardet et al.

* cited by examiner

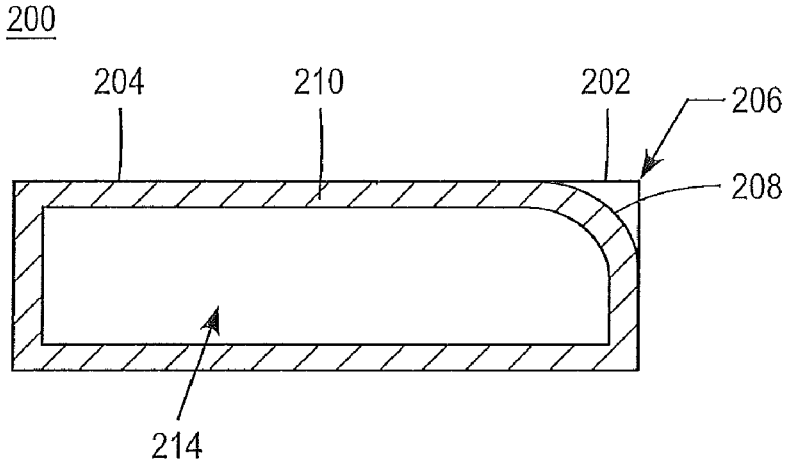
FIG. 5C
FIG. 6A
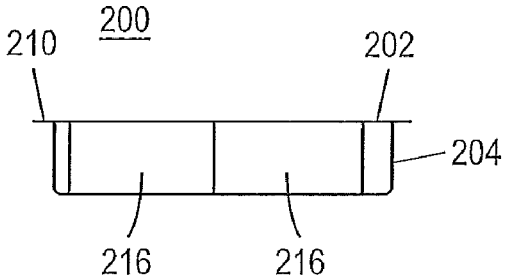
FIG. 6B
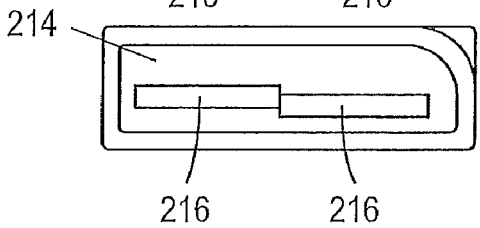
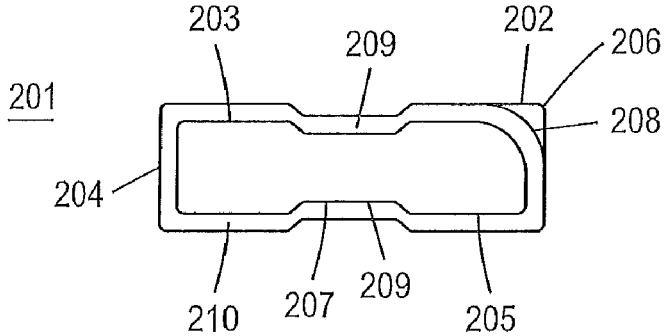
FIG. 7

ADJACENT ARTICLE PACKAGE FOR CONSUMER PRODUCTS

This application is a continuation application of U.S. application Ser. No. 12/634,331 entitled ADJACENT ARTICLE PACKAGE FOR CONSUMER PRODUCTS, filed on Dec. 9, 2009 now abandoned which claims benefit of the filing date of U.S. Provisional Application Ser. No. 61/122,068, filed Dec. 12, 2008, the entire content of each is incorporated herein by reference.

BACKGROUND

Cigarettes are sold in packages while tobacco products, such as chewing tobacco, are provided in different forms of packaging.

SUMMARY

An embodiment of a blank of foldable material for forming a cigarette package sleeve, comprises first, second, third and fourth panels for forming respective front, left side, back, and right side of the cigarette package sleeve, wherein each panel comprises two substantially parallel sides and two substantially parallel ends which are substantially perpendicular to the sides, the first panel connected to the second panel by a first fold line, the second panel connected to the third panel by a second fold line and the third panel connected to the fourth panel by a third fold line, wherein the first, second and third fold lines are along adjacent sides; a platform panel connected to an end of the third panel by a connect tab which is connected to the third panel by a fourth fold line and connected to the platform panel by a fifth fold line; an adhesive tab connected to a side of the fourth panel at a sixth fold line to join the first panel to the fourth panel; at least one locking tab connected to a short edge of the first, second or fourth panels at a seventh fold line and on the same end of the blank as the platform panel, wherein the locking tab is rotatable about the seventh fold line to engage the platform panel at a periphery thereof; wherein the blank is foldable to form a lower sleeve opening communicating with a lower recess between the first, second, third, fourth and platform panels at a lower end of the cigarette package sleeve and an upper opening communicating with an upper recess between the first, second, third, fourth and platform panels at an upper end of the cigarette package sleeve.

An embodiment of an adjacent article package comprises a parallelepipedal container having substantially rectangular opposed top and bottom end walls, opposed front and rear walls and opposed side walls adjoining the other walls; and a tray container which has a cover closed over an open space in a tray base, wherein a bottom of the tray base is adhesively bonded to the top wall of the parallelepipedal container.

BRIEF DESCRIPTION OF THE DRAWINGS

FIG. 5C is a top view of the tray container shown in FIG. 5A.

FIG. 6A is a side view of the tray container shown in FIG. 5A having a consumer product filled in an interior space of the tray container.

FIG. 6B is a top view of the tray container and consumer product shown in FIG. 6A.

FIG. 7 is a top view of another embodiment of a tray container having a narrow mid section.

DETAILED DESCRIPTION

According to an embodiment, an adjacent article package includes a sleeve containing a consumer product such as a cigarette package and a recess for holding a small supply of promotional items. Preferably, the adjacent article package is the size of a package of cigarettes, e.g., king size, 100's size, or slender size, or the like. Such a size of an adjacent article package fits within cigarette cartons and cigarette display racks. Furthermore, such a size of the adjacent article package can be tax-stamped with tax-stamping equipment. For instance, tax-stamping equipment removes the bottom of a cigarette carton, applies a tax stamp to each cigarette package contained therein and reattaches the carton bottom. Preferably, when the adjacent article package is about the size of a king size pack (package) of cigarettes (85 to 90×50 to 60×20 to 30 mm), the sleeve receives a first container (cigarette package) about a size of a regular pack of cigarettes, e.g., about 80 to 85×50 to 60×20 to 25 mm (e.g., 83×56×23 mm), about the size of a pack of slender cigarettes, e.g., about 83×53×23 mm, a rounded corner pack of cigarettes, e.g., having about 2 mm radii corners, or the like. Preferably, when the adjacent article package is about the size of a 100's size pack of cigarettes (100 to 110×50 to 60×20 to 30 mm), the first container is about a size of a king size pack of cigarettes, e.g., about 87×56×23 mm, about the size of a regular pack of cigarettes, about the size of a pack of slender cigarettes, about the size of a rounded corner pack of cigarettes or the like. Optionally, the adjacent article package may be about the size of a 120's pack of cigarettes (120 to 130×50 to 60×20 to 30 mm) and the first container may be the size of a 100s, king size, regular, slender or a rounded corner pack of cigarettes or the like.

Figure 1:
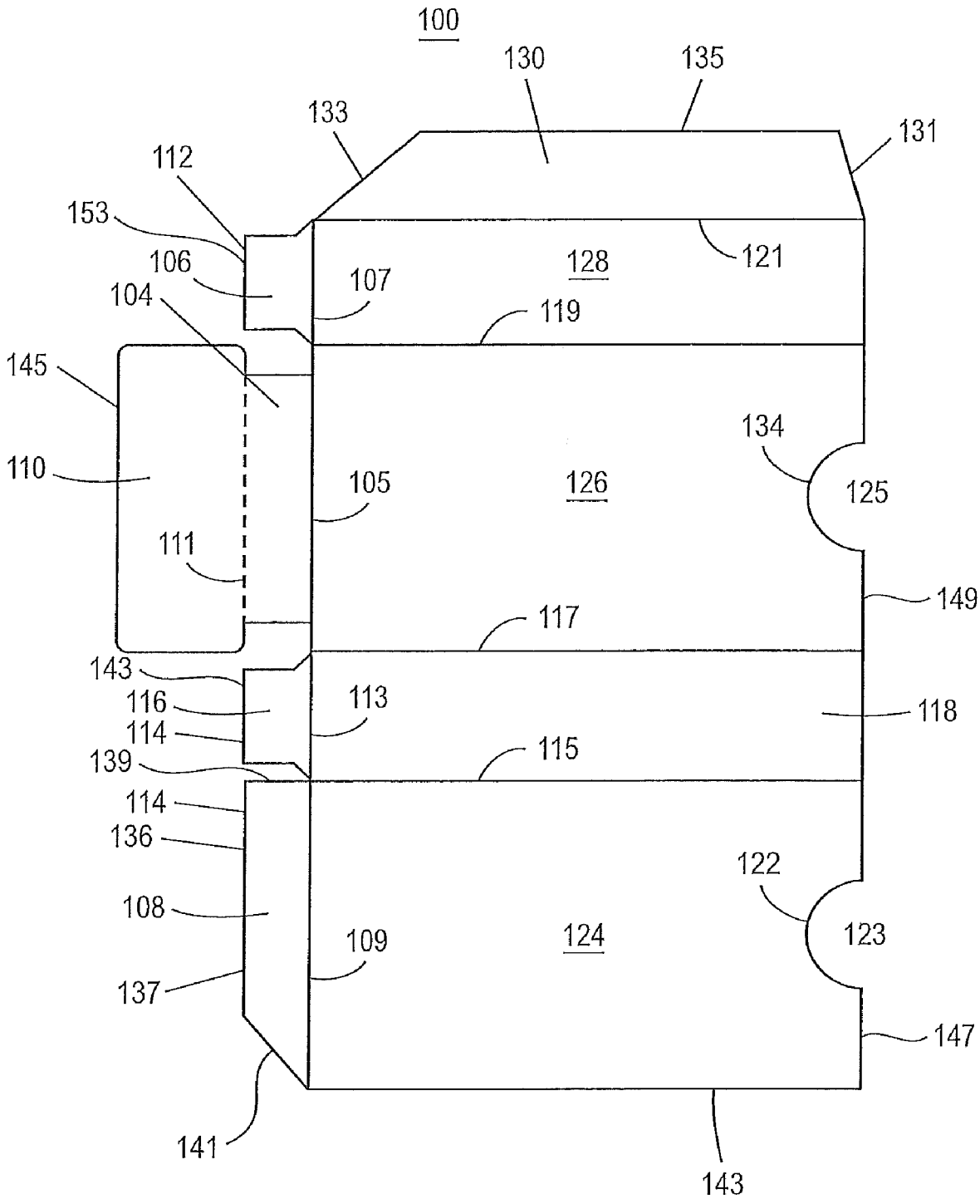
FIG. 1 is a plan view of an embodiment of a blank for forming a combining sleeve.

FIG. 1 illustrates a blank 100 for forming a combining sleeve of the adjacent article package adapted to be placed over a cigarette package and support a second container containing promotional products such as packaged tobacco pouched products, adjacent to the cigarette package on a platform, in a recess formed integrally with the combining sleeve. The first container can be, for example, soft pack or hinged-lid hard pack containing smoking articles, e.g., traditional cigarettes or non-traditional cigarettes such as described in commonly-owned U.S. Pat. Nos. 5,388,594, 5,505,214, 5,530,225, 5,591,368 and 7,185,659, their entire contents of which are hereby incorporated by reference.

The embodiment of the blank shown in FIG. 1 has a one-piece configuration and comprises a plurality of panels and tabs. The panels are folded to form the combining sleeve. Beginning on one side of the illustrated blank 100, the blank 100 includes a first panel 124, a second panel 118, a third panel 126 and a fourth panel 128, each having a substantially rectangular shape of opposed long sides and opposed short sides perpendicular to the long sides. Preferably, the first panel 124 is substantially the same size and shape as the third panel 126 to form a front and back, respectively, of the formed combining sleeve. Also preferably, the second and fourth panels 118/128 are of substantially matching size and shape to form left and right sides of the formed combining sleeves respectively.

A side of the first panel 124 is connected to an adjacent side of the second panel 118 at a first fold line 115. The other side of the second panel 118 is connected to an adjacent side of the third panel 126 at a second fold line 117. The other side of the third panel 126 is connected to an adjacent side of the fourth panel 128 at a third fold line 119.

The third panel 126 is connected to a platform panel 110 by a connect tab 104 which is connected to an end of the third panel 126 by a fourth fold line 105 and connected to the platform panel 110 by a fifth fold line 111. Preferably, the fifth fold line 111 includes perforations and is parallel to the fourth fold line 105.

The other side of the fourth panel 128 is connected to an adhesive flap 130 at a sixth fold line 121. When the blank 100 is folded at the fold lines 115, 117, 119 and 121, a portion of the first panel 124 overlies the adhesive flap 130. Preferably, the adhesive flap 130 is trapezoidal having the fold line 121 as one of the sides thereof, where the fold line 121 is about 0.5 to 2% shorter than fold line 119 on the other side of the fourth panel 128. Non-parallel ends A 131 and 133 of the adhesive panel 130 taper to the other, shorter, side 135 of the adhesive panel 130. Preferably, the first non-parallel side A 131 tapers steeply from the other long edge of the fourth panel 128 and a second non-parallel edge tapers less steeply and meets the fourth panel 128 at a end of the fourth panel 128. Preferably, an adhesive is applied to a surface of the adhesive flap 130 to bond the first panel 124 adjacent to the fourth panel 128 at about the sixth fold line 121 to form a hollow sleeve.

The embodiment of the blank 100 shown in FIG. 1 has a first locking tab 108 connected to an upper short end of the first panel 124 at a seventh fold line 109 on the same end of the blank 100 as the platform panel 110. The first locking tab 108 is preferably a shape having two parallel sides 109 and 137 where the 7th fold line 109 is one of the parallel sides, an extension of the first fold line 115 is a third side 139 connecting and perpendicular to the parallel sides 109/137 of the first locking tab 108, and the other parallel side 137 is shorter than the 7th fold line 109 and spaced apart from the 7th fold line 109 a distance equal to the distance between the fourth fold line 105 and the fifth fold line 111 defining a length of the connect tab 104. Preferably, the other non-parallel side 141 of the first locking tab 108 is an extension of terminating side 151 of the first panel 124 for a straight distance and then tapers to the other parallel side 137 of the first locking tab 108. Preferably, the straight distance is about 5–12% of the distance between the spaced apart parallel edges.

According to the embodiment of the folding blank 100 shown in FIG. 1, second and third locking tabs 116/106 are disposed on the second and fourth panels 118/128, respectively, at eighth and ninth fold lines 113/107. The second locking tab 116 is connected to an upper end of the second panel 118, on the same end of the blank 100 as the platform panel 110, at the eighth fold line 113. The third locking tab 106 is connected to an upper end of the fourth panel 128, on the same side of the blank as the platform panel 110, at the ninth fold line 107. The second and third locking tabs 116/106 are narrow extensions of the second and fourth panels 118/124, each locking tab terminating in a side 143/153 parallel to the respective fold line 113/107 and spaced apart from the respective fold line 113/107 by the distance between the fourth and fifth fold lines 105/111 on opposed sides of the connect tab 104. Each narrow extension connects to the respective second and fourth panel 118/128 at the respective eighth and ninth fold line 113/107 by a flared section. Preferably, each flared section comprises opposed tapered edges.

Preferably, the platform panel 110 is substantially rectangular having rounded corners, opposed sides, opposed ends and the fifth fold line 111 lying along one side. The terminating side 145 of the platform panel 110 is spaced apart from the fifth fold line 111 by about the width of the second and fourth panels 118/128, (the distance from fold line 115 to fold line 117 and the distance from fold line 119 to fold line 121). The ends of the platform panel 110 are spaced apart by about the width of the first panel 124 and the third panel 126, (the distance from terminating side 151 and to fold line 115 from fold line 117 to fold line 119).

Preferably, the connect tab 104 is substantially rectangular having the fourth and fifth fold lines 105/111 as opposed sides and opposed ends spaced apart by about 10-60% (e.g., about 15-25%) less than the opposed sides of the platform panel 110. In a preferred embodiment, the fourth and fifth fold lines 105/111 are centered on the upper end of the third panel 126 and along the side of the platform panel 110, respectively.

Optional cut out sections can be located on the first, second, third and fourth panels 124/118/126/128. Preferably, semi-circular cut outs 123 and 125 defined by tear lines 122 and 134 can be centered along respective lower ends 147/149 of the first and third panels 124/126.

The blank 100 can be composed of any suitable material, e.g., plastic, metal, foil, paper board and combinations thereof. Preferably, the blank 100 is composed of a paper suitable for forming hinged-lid cigarette boxes. The blank 100 can include one or more layers of the paper material.

In a preferred embodiment, the first panel 124 and the third panel 126 are about 90–130 mm×50–60 mm (e.g., about 110–120 mm×54–58 mm or about 95–105 mm×54–58 mm), the second panel 118 is about 90–mm×17–30 mm (e.g., about 110–120 mm×22–25 mm or about 95–105 mm×22–25 mm) and the fourth panel 128 is about 90–130 mm×16–29 mm (e.g., about 110–120 mm×21–24 mm or about 95–105 mm×21–24 mm). The fourth panel 128 is preferably narrower than the second panel 118 by about the thickness of the blank material (e.g., about 0.1–1.0 mm, about 0.2–0.4 mm or 0.11 PT board), such that when the first panel 124 overlies the adhesive tab/130, the formed combining sleeve has a substantially rectangular cross section.

In a preferred embodiment, the connect tab 104 of the blank 100 extends about 10–15 mm (e.g., about 11–13 mm) from the fourth fold line 105 to the fifth fold line 111 and is about 40–50 mm (e.g., about 44–47 mm) wide in a perpendicular direction thereto. The platform panel 110 is about 50–60 mm×16–30 mm (e.g., about 54–58 mm×21–25 mm). Preferably, the short parallel side 137 of the first locking tab 108 is about 10–20 mm (e.g., 12–15 mm) shorter than the seventh fold line 109, the narrow portions of the second and third locking tabs 116/106 are about 4–8 mm (e.g., 5–7 mm) narrower than the respective second and fourth panels 118/128 and the flared portions extend along the respective locking tabs about 15–30% (e.g., 22–27%) of the distance to the respective terminating edges. The second locking tab 116 is preferably symmetrically disposed on the eighth fold line 113 and the third locking tab 106 is preferably symmetrically disposed on the ninth fold line 107.

In a preferred embodiment, the adhesive tab 130 extends about 13–19 mm (e.g., about 15–17 mm) from the sixth fold line 121 to the short parallel side 135 which is about 18–29 mm (e.g., about 22–26 mm) shorter than the other side of the fourth panel 128 (fold line 119) such that the upper non-parallel end 133 of the adhesive tab 130 joins the short parallel side 135 at an obtuse angle a distance of about 15–23 mm (e.g., 18–21 mm) below the upper end (fold line 107) of the fourth panel 121 and the lower non-parallel edge 131 of the adhesive tab 130 joins the short parallel side 135 at another obtuse angle a distance of about 3–6 mm (e.g., about 4–5 mm) above the lower end of the fourth panel 128.

Now a method of folding the blank 100 with reference to FIGS. 2A-2D will be described to form an embodiment of a combining sleeve (cigarette package sleeve) as shown, for example, in FIGS. 3A-3D.

Figure 2A:
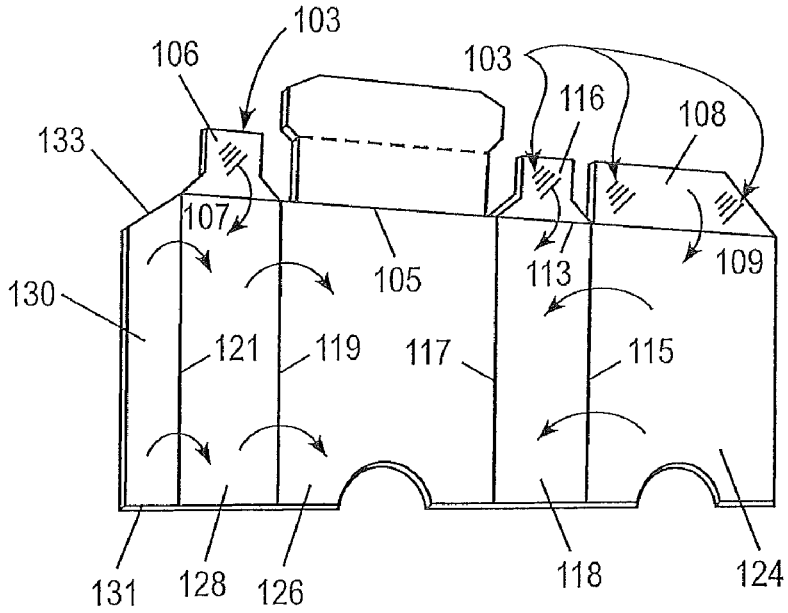
FIGS. 2A-2D show operations of folding the blank shown in FIG. 1.
Figure 2B:
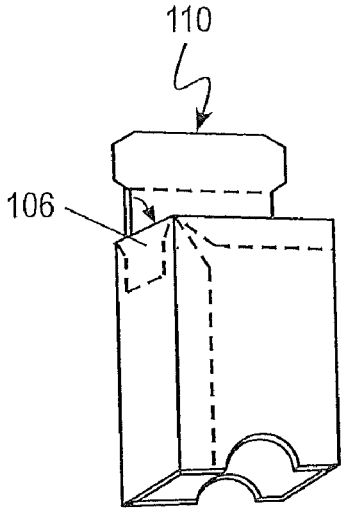
Figure 2C:
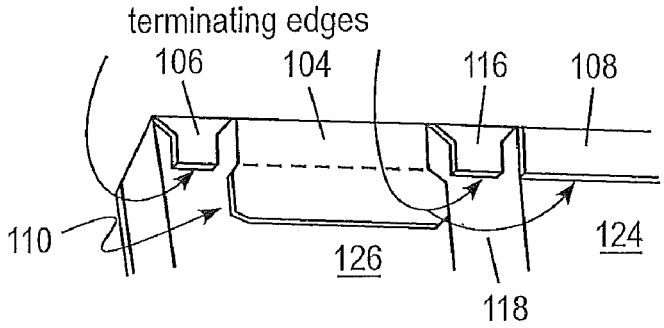
Figure 2D:
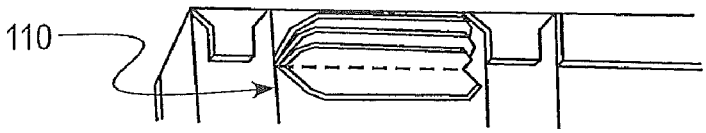

Preferably, adhesive is applied to a face of each locking tab 106/116/108. Locking tabs 106, 116 and 108 are folded about 180 degrees at the respective fold lines 109/113/107 and adhesively bonded to respective upper portions of the first, second and fourth panels as shown in FIGS. 2A-2C. Preferably, the first, second, third and fourth panels 124/118/126/128 and the adhesive tab 130 are folded at the first, second, third and sixth fold lines 115/117/119/121 to form a prefolded partially glued pre-sleeve that can be mass handled at a high rate of speed in a packaging apparatus if desired.

Figure 3C:
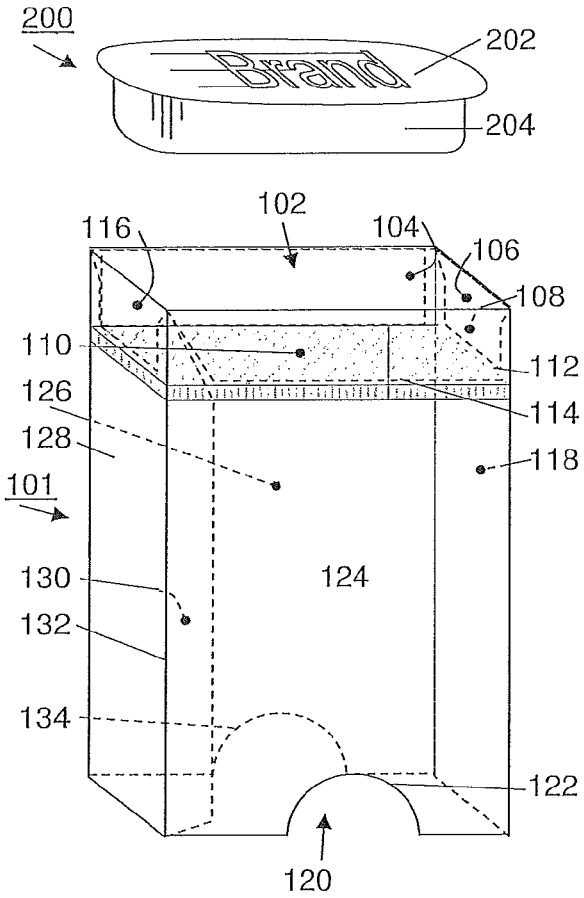
FIG. 3C is a side view of the tray container and rectangular prism container in the formed combining sleeve shown in FIG. 3A.
Figure 3C:
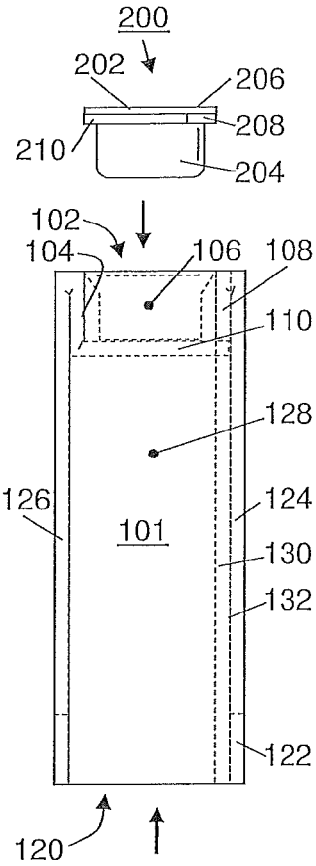
Figure 3C:
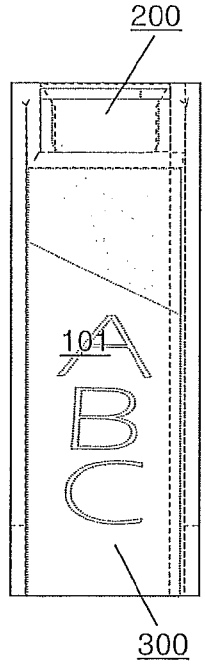
Figure 3A:
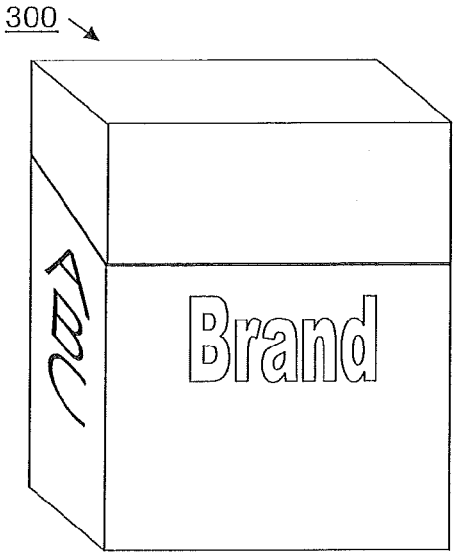
FIG. 3A illustrates a combining sleeve formed by folding the blank shown in FIG. 1 with a tray container and a rectangular prism container to be placed in the formed combining sleeve.

Preferably, the connect tab 104 is folded about 180 degrees at the fourth fold line 105 in the same direction as the locking tabs 108/116/106. The platform panel 110 is folded at the fifth fold line in a direction opposite to the direction of the connect tab 104 fold by about 90 degrees such that the platform panel 110 is perpendicular to the third panel 126. Preferably, the platform panel 110 is folded simultaneously while the first, second, third and fourth panels 124/118/126/128 and adhesive tab 130 are folded 126. Preferably, a portion of the first panel 124 overlies and is adhesively bonded to the adhesive panel 130, forming an erected combining sleeve 101 as shown in FIG. 3A. When the portion of the first panel 124 overlies the adhesive tab 130 forming the combining sleeve 101, the terminating edges of the locking tabs 112/114/136 engage the platform panel 110 at a periphery thereof forming an upper opening and an upper recess space 102. When the blank 100 is erected into the combining sleeve 101 a lower opening and a lower recess 120 are also formed.

Although embodiments of the blank 100 and the formed combining sleeve 101 are described as comprising first, second and third locking tabs 108/116/106, all three locking tabs are not necessarily required. Optionally, one or two locking tabs can be used to engage the platform panel 110 in alternative embodiments.

As illustrated in FIG. 3A, when the blank 100 is folded into a combining sleeve 101, the first panel 124, the second panel 118, the third panel 126 and the fourth panel 128 form outer faces of the combining sleeve 101. Particularly, an outer surface of the first panel 124 forms a single outer front face of the combining sleeve 101 and the other surface of the first panel 124 forms an inner front face of the lower recess 120 below the folded platform tab 110. Above the folded platform tab 110, the inner surface of the first panel 124 lies under the first folded locking tab 108 which forms an inner front face of the upper recess 102. An outer surface of the second panel 118 forms a single outer left side face of the combining sleeve 101 and the other inner surface forms an inner side face of the lower recess 120 below the folded platform tab 110. Above the platform tab 110, the inner surface of the second panel 118 lies under the folded second locking tab 116 which forms an inner side face of the upper recess 102. Similarly, the outer surface of the third panel 126 forms a single outer front face of the combining sleeve 101 and the inner surface forms an inner front face of the lower recess 120 below the folded platform 110. Above the platform tab 110, the inner surface of the third panel 126 lies under the folded connect tab 104, which forms an inner front surface of the upper recess 102. Finally, the outer surface of the fourth panel 128 forms a single outer right side face of the combining sleeve 101. The inner surface of the fourth panel 128 forms an inner right side face of the lower recess 120 below the folded platform panel 110. Above the folded platform panel 110 the inner surface of the fourth panel 128 lies beneath the folded third locking tab 106 which forms the inner right side face of the upper recess 102. The outer surface of the folded platform panel 110 forms a bottom inner face of the upper recess 102 and the inner surface of the folded platform panel 110 forms a top inner surface of the lower recess 120.

Figure 3B:
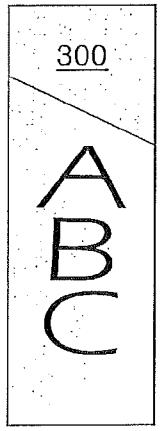
FIG. 3B is a side view of the formed combining sleeve, shown in FIG. 3A.
Figure 3D:
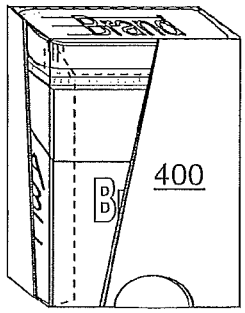
FIG. 3D shows a partial cutaway view of the formed combining sleeve shown in FIG. 3A supporting the tray container in an upper recess and surrounding the rectangular prism container in a lower recess.

FIG. 3A shows an embodiment of a first container which is parallelepipedal shaped, having substantially rectangular opposed top and bottom end walls, opposed front and rear walls and opposed side walls adjoining the other walls. such a parallelepipedal shaped container 300 can also be described as a rectangular prism. Containers for smoking articles, e.g., cigarettes are typically such rectangular prism shapes (cigarette packages). FIG. 3B shows a side view of the first container (cigarette package) 300 and the combining sleeve (cigarette package sleeve) 101 shown in FIG. 3A. The lower recess 120 of the combining sleeve 101 is sized to accept the parallelepipedal container 300. The inner faces of the first, second, third and fourth panels 124/118/126/128 telescope over and surround the front, rear and side walls of the parallelepipedal shaped first container 300 as shown in FIGS. 3C and 3D to frictionally hold the first container 300 within the lower recess 120. Preferably, the top end wall of the first container 300 engages the lower surface of the platform panel 110 and the bottom end wall of the first container 300 closes the lower sleeve opening of the combining sleeve 101.

Preferably, the first and third panels 124/126 each include a semi circular cut-out 123/125 located at the lower sleeve opening. Such cut-outs 123/125 allow a user to grip the first container 300 to withdraw the first container 300 from the combining sleeve 101. Although the cut-outs 123/125 are in the first and third panels 124/126 in the embodiments shown and described, cut-outs can be of various shapes and in any panel or combination of panels.

Preferably, centers of the cut-outs 123/125 are located at about the centers of the respective lower ends 147/149 of the first and third panels 124/126 where radii of tear lines 122 and 134 are about 8–12 mm (e.g., about 9–11 mm).

FIG. 3A shows an embodiment of a second container 200 which is tray shaped. The second container 200 includes a removable cover 202 a tray base 204. FIG. 3B shows a side view of the tray container 200 and the upper recess 102. The upper recess 102 of the combining sleeve 101 is sized to accept the tray container 200. As mentioned, the folded locking tabs 108/116/106 and connect tab 104 define the four inner faces of the upper recess 102 and the top surface of the folded platform panel 110 forms the bottom of the top recess 102.

Preferably, a bottom of the tray container 200 is adhesively bonded to the top surface of the platform panel 110 and closes the upper opening of the combining sleeve 101 as shown in FIGS. 3C and 3D. Although the top of the tray container 200 is shown as flush with the upper edge of the upper recess 102, according to other embodiments, the top of the tray container 200 may be below or above the upper edge of the upper recess 102.

Figure 4:
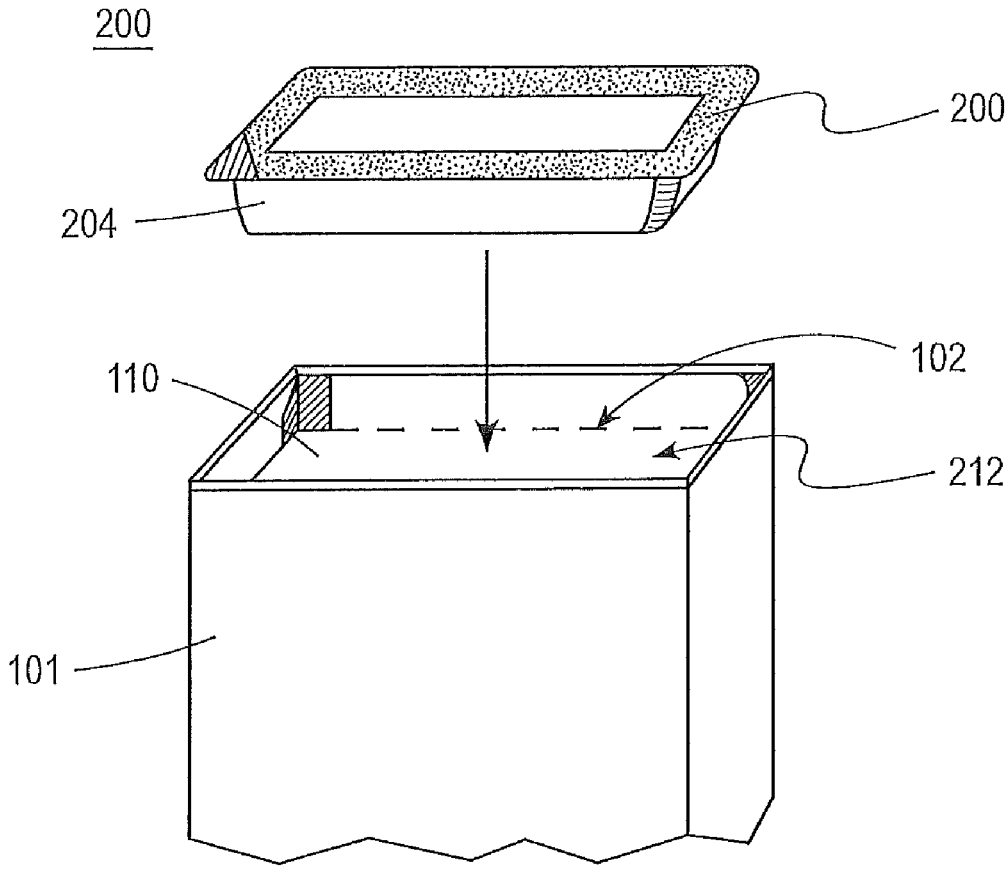
FIG. 4 is a view of another embodiment of a tray container.

FIG. 4 shows an embodiment of a tray container 200 to be bonded to the upper surface of the platform panel 110 in the upper recess 102. Preferably, adhesive 212 bonds the bottom of the base 204 to the platform panel 110.

Figure 5A:
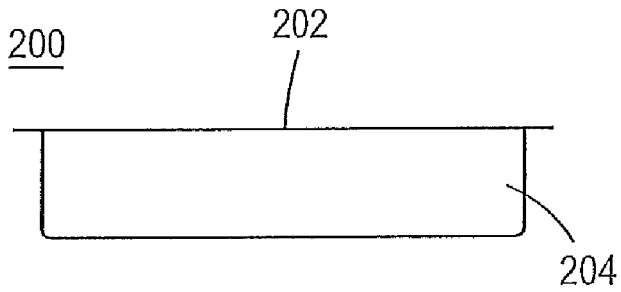
FIG. 5A is a side view of another embodiment of a tray container.
Figure 5B:
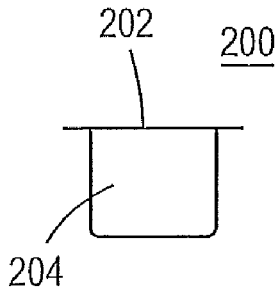
FIG. 5B is an end view of the tray container shown in FIG. 5A.

FIG. 5A shows a side view of the tray container 200. A cover 202 of the tray container 200 can be a membrane film hermetically sealed to an upper flange 210 (FIG. 3B) of a base 204. The base 204 has at least a portion of a bottom that is substantially flat. FIG. 5B shows an end view of the tray container 200. The base 204 of the tray container 200 is substantially rectangular having vertical sidewalls in the embodiment shown. FIG. 5C shows a top view of the tray container 200. The base 204 of the tray container has a flange 210 around the periphery of an opening to an interior space 214 of the tray container 200. The cover of the tray 202 is bonded to the flange 210 to enclose the tray container 200. Preferably, the cover 202 is hermetically sealed to the flange 210. Preferably, the cover 202 of the tray container 200 has squared corner 206 which over hangs a curved corner 208 of the flange 210. The overhanging squared corner 206 provides a thumb tab for a user to grip the container cover 202 during removal of the container cover 202 from the container base 204 to access the interior space 214.

In a preferred embodiment, the second container is a tray container 200 having a bottom of a base 204 about 55–65 mm×11–16 mm (e.g., about 57–63 mm×12–14 mm) with rounded corners having radii about 0.5–2 mm (e.g., about 1 mm) connected to sidewalls extending about 11–16 mm (e.g., about 12–14 mm) above the base, where opposed long sidewalls are spaced apart by about 13–19 mm (e.g., about 15–17 mm) and opposed short sidewalls are spaced apart by about 55–65 mm (e.g. about 57–63 mm). Preferably, the flange 210 around the periphery of the opening formed by the sidewalls of the tray container 200 is about 1–5 mm (e.g., about 2–4 mm) wide. Preferably, the cover 202 is about 60–70 mm×18–26 mm (e.g. about 64–68 mm×20–24 mm) and has squared corner radii of about 1–3 mm (e.g., about 2 mm).

FIGS. 6A and 6B show a side view and top view, respectively, of an embodiment of a tray container 200 including consumer products 216 contained in the interior space 214 of the tray container 200. In a preferred embodiment, the consumer products 216 include smokeless tobacco products such as pouched smokeless tobacco (SNUS).

FIG. 7 shows a top view of another preferred embodiment of a tray container 201. The substantially rectangular bottom of the base 204 includes a first wide section 203 spaced apart from a second wide section 205 by a narrow midsection 207. The vertical sidewalls of base 204 include indents 209 along opposed long sides of the substantially rectangular shape, thus defining the narrow midsection 207. The flange 210 also includes first and second wide sections spaced apart by a narrow midsection as defined by the periphery of the opening to the interior 214 of the base 204 according to the embodiment.

FIG. 3D shows an adjacent article package 400 formed when the first container 300 and second container 200 are inserted in the combining sleeve 101. Preferably, the adjacent article package 400 is of a size and shape to be used in tax-stamping operations with tax-stamping machines (represented by arrow "A" in FIG. 9).

Figure 8:
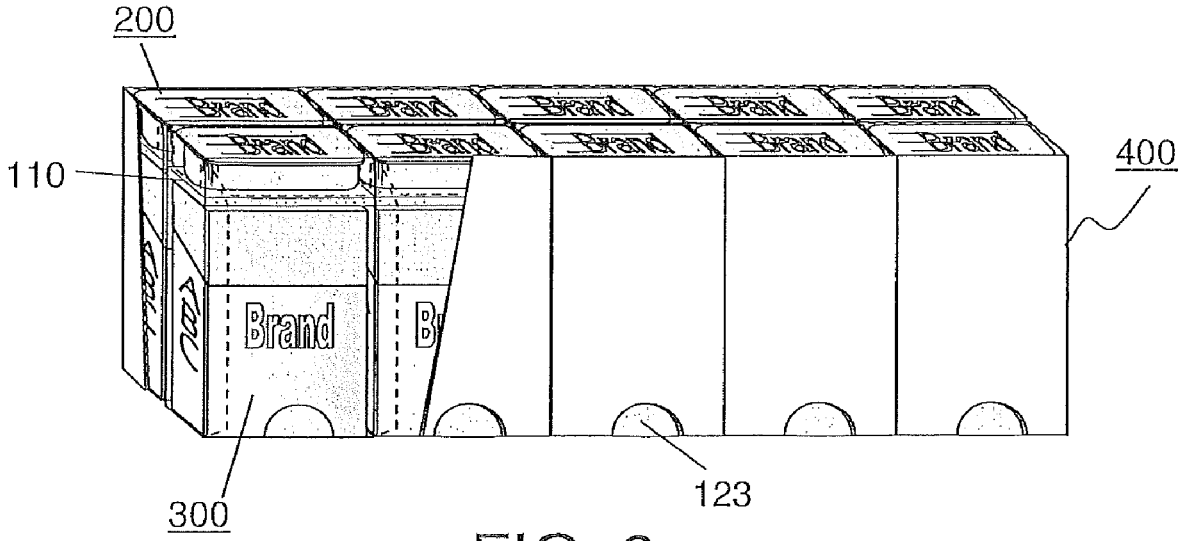
FIG. 8 shows an embodiment of formed combining sleeves each surrounding a rectangular prism container in a lower recess and a tray container in an upper recess.
Figure 9:
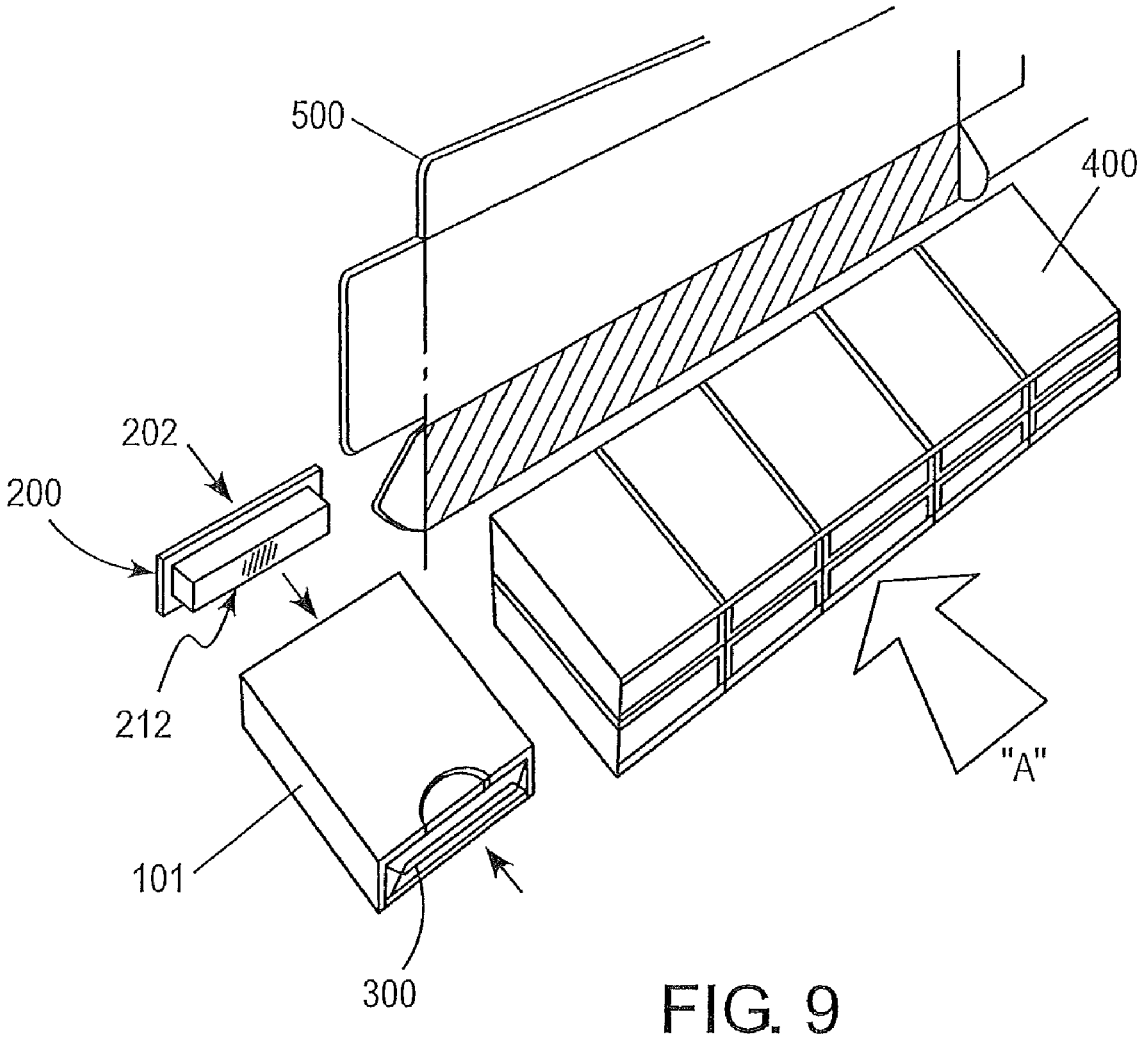
FIG. 9 shows an embodiment of formed combining sleeves each surrounding a rectangular prism container in a lower recess and a tray container in an upper recess, arranged to be wrapped by a carton blank.

Preferably, when the adjacent article packages 400 are arranged for packaging in a carton (FIG. 8) each adjacent article package 400 is of a size and shape to allow a carton machine to form the carton around the adjacent article packages 400 from a carton blank 500 (FIG. 9). For example, commonly-assigned U.S. Pat. No. 7,234,593, the entire content of which is hereby incorporated by reference, describes loading cartons and applying tax stamps to individual packs before the carton is sealed.

The combining sleeve can be used with various first containers having a rectangular longitudinal cross-sectional shape and second containers of various shapes. The first containers can be soft packs or hard packs made from cardboard in which cigarettes are stored. Such containers can include a top portion hinged to a bottom portion. Such containers can have an outer cellophane wrapper to retain the freshness of the smoking articles. One of such containers can be inserted into the lower recess 120 of the formed combining sleeve 101, such that the sleeve overlies the front face, side faces and rear face of the container. Alternatively, the blank can be placed on the container and folded to form the sleeve. One or more objects, or objects in a second container, such as promotional products, can then be inserted in the upper recess 102.

Figure 10A:
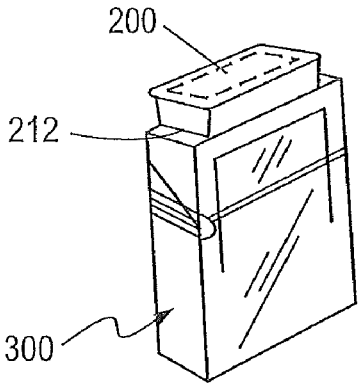
FIGS. 10A-10C show another embodiment of adjacent article packaging.

According to another embodiment, shown in FIG. 10A the first container 300 has the second container 200 attached to a top end wall. Preferably, embodiments of the first container are parallelepipedal shaped containers as previously described, therefore, further description of the first container will be omitted here. Preferably, embodiments of the second container are tray shaped containers as previously described and as such, further description of the second container will be omitted here except for embodiments of the container cover.

Figure 10B:
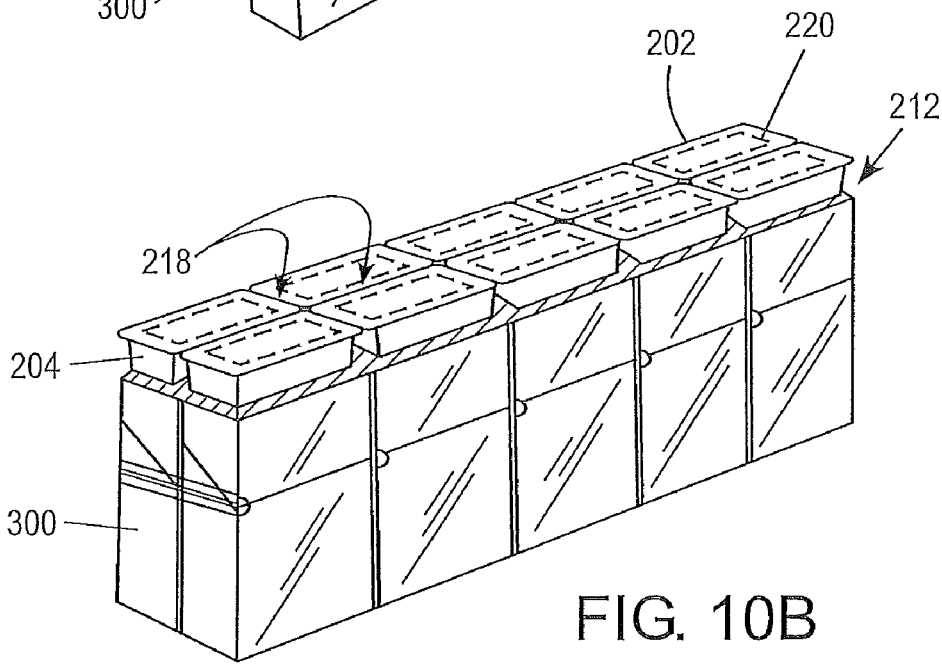

FIG. 10B shows an embodiment of a plurality of second containers 200 adhesively bonded to a plurality of first containers 300 (cigarette packages). Preferably, the plurality of cigarette packages 300 are joined together by a separable sheet 220. The separable sheet 220 forms removable covers 202 of the plurality of tray containers 204 where each of the tray containers 204 is attached to one of the cigarette packages 300. Preferably, covers 202 of the plurality of second containers 200 are connected at perforations 218 in the membrane covering 220. That is, the covers 202 can be formed from the membrane covering 220 bonded to the plurality of flanges 210 of the tray container bases 204, and perforated between container bases 204 by perforations 218.

FIG. 10A shows an adjacent article package 400 formed when the first container 300 and second container 200 are adhesively bonded together. Preferably, the adjacent article package 400 is of a size and shape to be used in tax-stamping operations with tax-stamping machines (represented by arrow "A" in FIG. 10C).

Figure 10C:
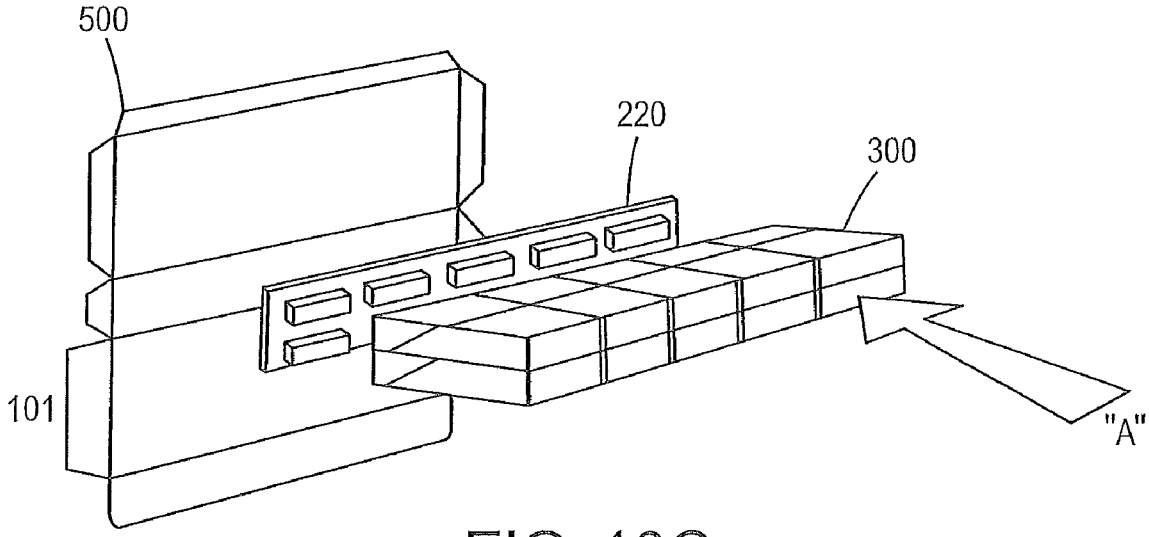

Preferably, when the adjacent article packages 400 are arranged for packaging in a carton each adjacent article package 400 is of a size and shape to allow a carton machine to form the carton around the adjacent article packages 400 from a carton blank 500 (FIGS. 10B and 10C). Also preferably, when adjacent article packages 400 are arranged for packaging in a carton and joined by a perforated cover membrane 220 in a preferred number to be packed into a carton (e.g., 8 or 10), the joined adjacent article packages 400 are of a size and shape to be used in tax-stamping operations with tax-stamping machines.

While the invention has been described in detail with reference to specific embodiments thereof, it will be apparent to those skilled in the art that various changes and modifications can be made, and equivalents employed, without departing from the scope of the appended claims.

The invention claimed is:

1. A blank of foldable material for forming a combining sleeve, comprising:

first, second, third and fourth panels for forming respective front, left side, back, and right side of the combining sleeve, wherein each panel comprises two substantially parallel sides and two substantially parallel ends which are substantially perpendicular to the sides, the first panel connected to the second panel by a first fold line, the second panel connected to the third panel by a second fold line and the third panel connected to the fourth panel by a third fold line, wherein the first, second and third fold lines are along adjacent sides;

a platform panel connected to an end of the third panel by a connect tab which is connected to the third panel by a fourth fold line and connected to the platform panel by a fifth fold line;

an adhesive tab connected to a side of the fourth panel at a sixth fold line to join the first panel to the fourth panel;

at least one locking tab connected to an end of the first, second or fourth panels at a seventh fold line and on the same end of the blank as the platform panel, wherein the locking tab is rotatable about the seventh fold line to engage the platform panel at a periphery thereof;

wherein the blank is foldable to form a lower sleeve opening communicating with a lower recess between the first, second, third, fourth and platform panels at a lower end of the combining sleeve and an upper opening communicating with an upper recess between the first, second, third, fourth and platform panels at an upper end of the combining sleeve;

wherein respective first, second and third locking tabs are connected to respective ends of the first, second and fourth panels at respective fold lines on the same end of the blank as the platform panel, wherein the locking tabs are rotatable about each respective fold line to extend equally to engage the periphery of the platform panel.

2. The blank of claim 1, wherein the first and third panels each include a semicircular cut-out located at the lower sleeve opening.

3. The blank of claim 1, wherein the fifth fold line comprises perforations.

4. The blank of claim 1, wherein the platform panel has at least a portion as wide as the third panel and as deep as the width of the second and fourth panels, the connect tab is narrower than the third panel, the locking tabs connected to the second and fourth panels have portions narrower than the second and fourth panels and have flared sections connecting the narrower portions to the respective fold lines, and the locking tab connected to the first panel is trapezoidal wherein the fold line connected to the end of the first panel is one parallel edge of the trapezoid.

5. The blank of claim 1, wherein an adhesive material is provided on at least a portion of a face of each of the locking tabs and the adhesive tab.

6. A combining sleeve formed from a folded blank according to claim 1, wherein:

the first panel forms a single outer front face of the combining sleeve, an inner front face of the lower recess and an inner front face of the upper recess;

the second and fourth panels form respective right and left outer side faces of the combining sleeve, respective inner right and left side faces of the lower recess and respective inner right and left side faces of the upper recess;

the third panel forms a single outer back face of the combining sleeve and an inner back face of the lower recess;

at least one locking tab overlies an inner portion of at least one of the first, second and fourth panels forming at least one of a respective inner front right and left side face of the upper recess;

the connect tab overlies an inner portion of the third panel forming an inner back face of the upper recess; and the platform panel forms an inner bottom face of the upper recess and an inner top face of the lower recess.

7. An adjacent article package comprising:

a parallelepipedal container;

a combining sleeve according to claim 6 telescoped over and surrounding the parallelepipedal container with a friction fit therebetween to hold the parallelepipedal container in the lower recess; and a tray container which has a removable cover enclosing a tray base, retained in the upper recess closing the upper opening of the combining sleeve.

8. The package of claim 7, wherein a bottom of the tray container is attached to the platform panel by an adhesive.

9. The package of claim 7, wherein the parallelepipedal container comprises a pack of cigarettes and the tray container contains smokeless tobacco articles.

10. The package of claim 7, wherein the tray base comprises:

an upper flange and a curved end wall and the cover comprises a membrane sealed to the flange.

11. The package of claim 10, wherein the tray base is thermoformed and the cover of the tray is hermetically sealed to the flange, the membrane comprising a plastic film, foil or a composite thereof.

12. The package of claim 10, wherein the tray contains smokeless tobacco pouched products.

13. A method of forming a combining sleeve from a blank comprising:

first, second, third and fourth panels for forming respective front, left side, back, and right side of the combining sleeve, wherein each panel comprises two substantially parallel sides and two substantially parallel ends which are substantially perpendicular to the sides, the first panel connected to the second panel by a first fold line, the second panel connected to the third panel by a second fold line and the third panel connected to the fourth panel by a third fold line, wherein the first, second and third fold lines are along adjacent sides;

a platform panel connected to an end of the third panel by a connect tab which is connected to the third panel by a fourth fold line and connected to the platform panel by a fifth fold line;

an adhesive tab connected to a side of the fourth panel at a sixth fold line to join the first panel to the fourth panel;

at least one locking tab connected to an end of the first, second or fourth panels at a seventh fold line and on the same end of the blank as the platform panel, wherein the locking tab is rotatable about the seventh fold line to engage the platform panel at a periphery thereof;

wherein the blank is foldable to form a lower sleeve opening communicating with a lower recess between the first, second, third, fourth and platform panels at a lower end of the combining sleeve and an upper opening communicating with an upper recess between the first, second, third, fourth and platform panels at an upper end of the combining sleeve;

the method comprising:

folding the first, second, third and fourth panels and adhesive tab of the blank along the first, second, third and sixth fold lines and overlying the adhesive tab with a portion of the first panel to create a hollow sleeve having an upper opening and a lower opening;

folding the at least one locking tab into the upper opening along the seventh fold line;

folding the connect tab into the upper opening along the fourth fold line, wherein a surface of the connect tab faces an inward surface of the third panel;

folding the platform panel along the fifth fold line such that a peripheral portion of the platform panel meets an edge of the at least one locking tab to partition the hollow sleeve into an upper recess and an adjacent lower recess.

14. The method of claim 13, further comprising filling the lower recess with a container and placing a tray container in the upper recess to produce a filled combining sleeve.

15. The method of claim 14, further comprising:

adhesively bonding the adhesive tab to the overlying portion of the first panel;

adhesively bonding a surface of the at least one locking tab to an underlying surface of at least one of the first, second and third panels; and adhesively bonding the tray container to the platform panel in the upper recess space.

16. The method of claim 14, further comprising filling a carton with a plurality of filled combining sleeves.

* * * * *